US006068389A

United States Patent [19]

Lai

[11] Patent Number: 6,068,389

[45] Date of Patent: May 30, 2000

[54] FIXTURE FOR A LIGHT BULB HOLDER ON A LIGHT STRING TO CONNECT WITH A FRAME

[76] Inventor: Wei-Cheng Lai, 9-47, Ho Shin, Ho Shin Tsung, Hu Ko Hsang, Hsinchu Hsien, Taiwan

[21] Appl. No.: 09/056,788

[22] Filed: Apr. 8, 1998

[51] Int. Cl.[7] ..... F21V 21/00

[52] U.S. Cl. ..... 362/396; 362/249; 362/250; 362/252; 362/422

[58] Field of Search ..... 362/396, 422, 362/248, 439, 282, 249, 250, 252

[56] References Cited

U.S. PATENT DOCUMENTS 5,791,765 9/1998 Lin ..... 362/396

*Primary Examiner*—Stephen Husar
*Assistant Examiner*—Anabel Ton
*Attorney, Agent, or Firm*—Rosenberg, Klein & Lee

[57] ABSTRACT

This invention relates to a fixture, which is an elastic ring,, for clipping a bulb holder of a light string and engaging with a hole on a frame being capable of various shapes. The fixtures are able to connect the light strings with the frame firmly and that can provide a desired lighting decoration which is designed as the frame when the bulbs are lightened.

1 Claim, 3 Drawing Sheets

FIXTURE FOR A LIGHT BULB HOLDER ON A LIGHT STRING TO CONNECT WITH A FRAME

BACKGROUND OF THE INVENTION

In order to obtain a special decoration, a series of light strings are winded around a specific frame and when the bulbs on the strings are lightened, it shows a lighting effect that has the same shape as the shape of the specific frame. Since the light strings are simply winded on the frame, they are usually fallen and the specific shape can not be kept.

OBJECT OF THE INVENTION

The main object of the present invention is to provide a fixture which is provided for elastic clipping the bulb holders on the light strings and connecting with the frame easily. That displays a desired lighting effect of a configuration of the frame.

The detailed structure, features, and other advantages of this invention will become apparent from the following detailed description of a preferred embodiment when read with reference to the accompanying drawings.

DETAILED DESCRIPTION OF THE EMBODIMENT

Figure 1:
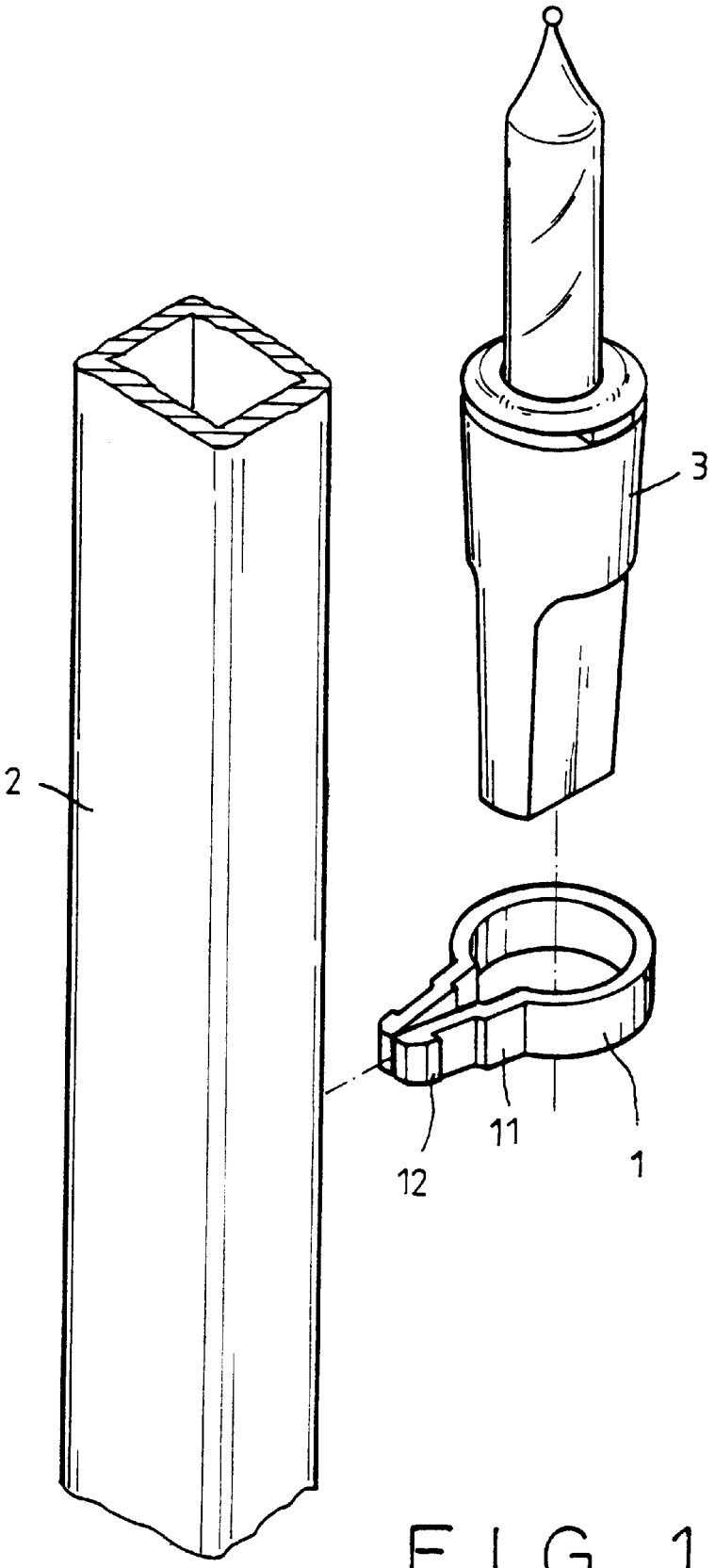
FIG. 1 is an exploded perspective view showing a fixture with a bulb holder and a part of the frame according to the present invention.
Figure 2:
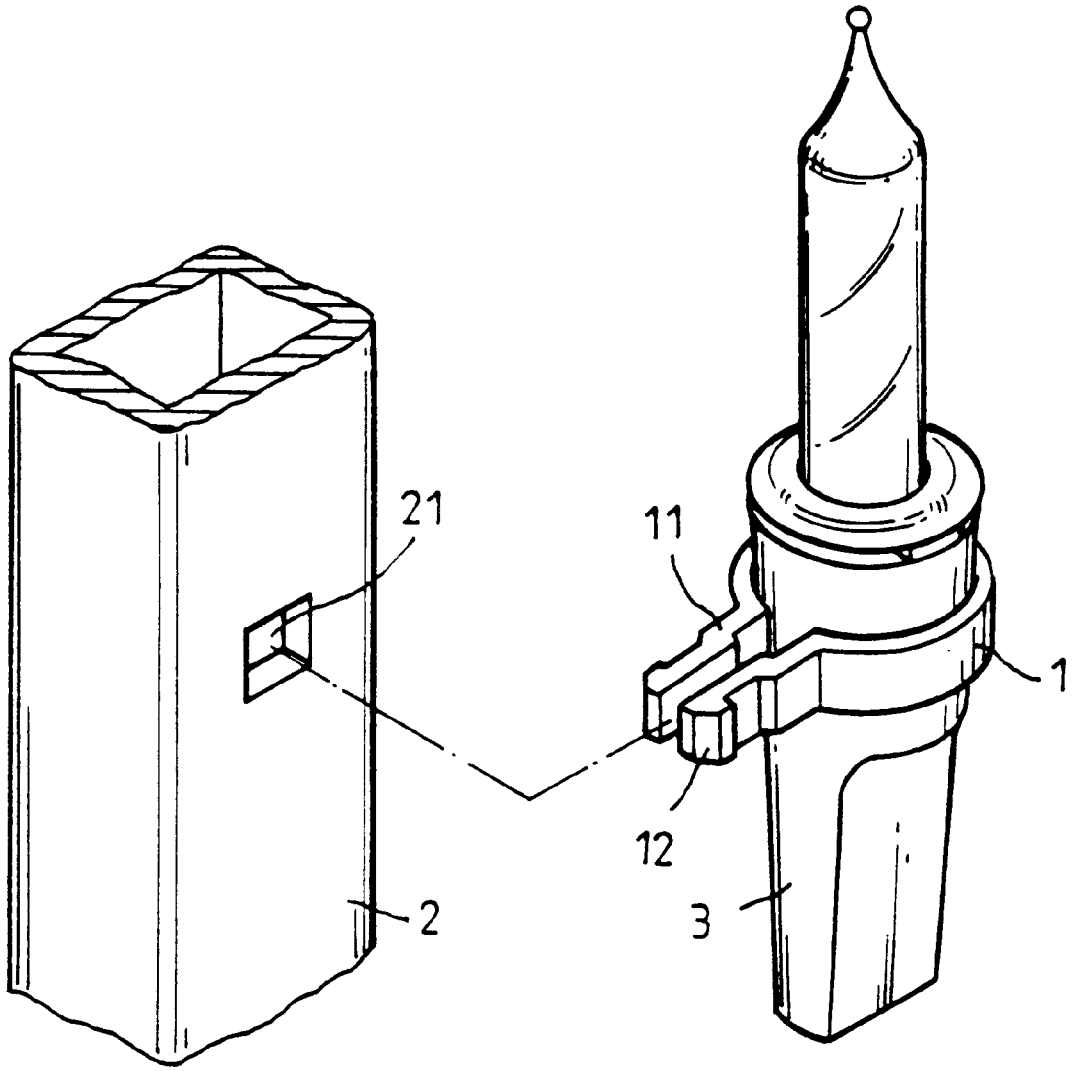
FIG. 2 is a perspective view showing the fixture connecting with the bulb holder of FIG. 1.
Figure 4:
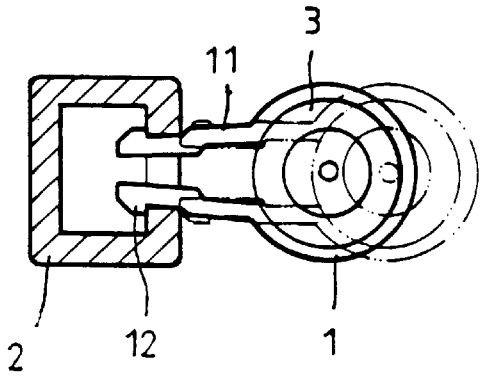
FIG. 4 is a top view of FIG. 3.
Figure 3:
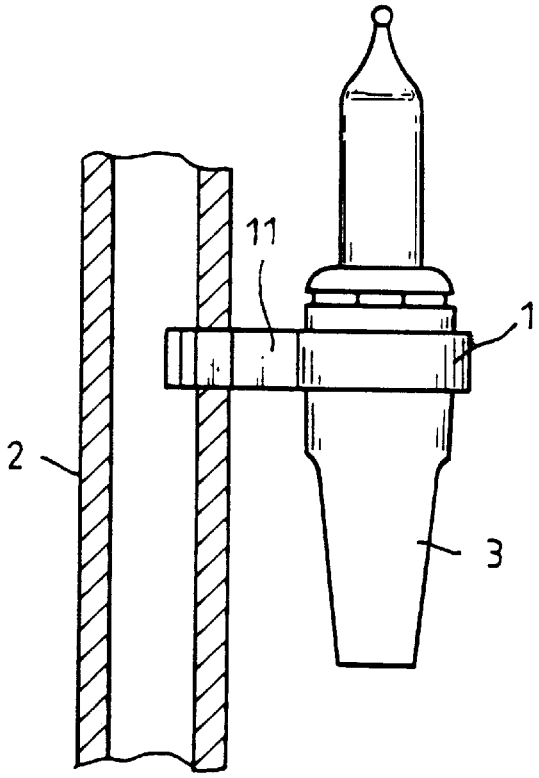
FIG. 3 is a cross sectional view of FIG. 2 when engaging with the frame.

Please refer to FIGS. 1 to 3, the present invention mainly includes a fixture (1), which is an elastic ring and has a pair of side connecting plates (11). The end of each plate (11) is a hook (12). A plurality of holes (21) are formed on a frame (2). In use, the bulb holder (3) is clipped by the fixture (1) and the plates (11) of the fixture (1) are moved outward, as shown in FIG. 2. Because the plates (11) are elastic, they can be pressed to be inserted into the hole (21 ) on the frame (2), as shown in FIG. 4. The hooks (12) of the plates (11) are therefore engaged with the frame (2) elastically. It can be understood that each bulb holder (3) with the bulb of the light strings is capable of firmly connecting with the frame.

The frame can be designed in various shapes and by use of the fixtures, the light strings can be firmly engaged with the frame. When the bulbs are lightened, a desired lighting figure is then provided and promised.

In conclusion, the present invention provides an obvious advantage, that includes the fixtures for easily connecting with the bulb holders on the light strings and engaging firmly with the frame to display a lighting decoration, which is the same outlook as the configuration of the frame. Thus, the present invention should be allowed for patent.

I claim:

1. An apparatus for attaching a lamp socket to a frame, the frame having at least one wall and at least one opening formed in said at least one wall, said apparatus comprising:

an elastic ring having an annularly extending wall defining a socket receiving opening adapted for removably receiving the lamp socket there, said annularly extending wall circumscribing the outer periphery of the lamp socket, a pair of spaced side connecting plates radially extending outwardly from respective ends of said annularly extending wall; and a pair of hooks respectively formed on said pair of side connecting plates and extending outwardly in opposing directions, each said hook being formed at an end portion of a respective one of said side connecting plates, said pair of side connecting plates passing through the at least one opening defined within the at least one wall of the frame, and said hooks resiliently engaging a rear surface of the at least one wall in close proximity to the opening, thereby clamping the lamp socket to the at least one wall of the frame.

* * * * *